US009516963B2

(12) United States Patent
Sarver et al.

(10) Patent No.: US 9,516,963 B2
(45) Date of Patent: Dec. 13, 2016

(54) KITCHEN UTENSIL WITH ADJUSTABLE SERVING SURFACE

(71) Applicants: Garry Sarver, Rockford, IL (US); Erin Hughes, Rockford, IL (US)

(72) Inventors: Garry Sarver, Rockford, IL (US); Erin Hughes, Rockford, IL (US)

(73) Assignee: Garry Sarver, Rockford, IL (US)

( * ) Notice: Subject to any disclaimer, the term of this patent is extended or adjusted under 35 U.S.C. 154(b) by 0 days.

(21) Appl. No.: 14/506,327

(22) Filed: Oct. 3, 2014

(65) Prior Publication Data

US 2015/0097387 A1 Apr. 9, 2015

Related U.S. Application Data

(60) Provisional application No. 61/886,749, filed on Oct. 4, 2013.

(51) Int. Cl.
*A47G 21/04* (2006.01)
*A47J 43/28* (2006.01)

(52) U.S. Cl.
CPC ..... *A47G 21/045* (2013.01)

(58) Field of Classification Search
CPC ..... A47G 21/045
USPC ..... 294/7, 16, 15, 99.2, 34, 31.1; D7/688, D7/692, 687
See application file for complete search history.

(56) References Cited

U.S. PATENT DOCUMENTS 783,244 A * 2/1905 Burns ..... B25B 9/02 294/15
1,637,607 A * 8/1927 Eggers ..... B26B 19/24 30/234
2,063,432 A * 12/1936 Greene ..... A47J 43/283 294/7
2,573,922 A * 11/1951 Meyer ..... A47J 43/283 294/7
2,613,979 A * 10/1952 Stillabower ..... A47J 45/10 294/103.1
2,757,951 A * 8/1956 Benton ..... A22C 25/06 294/99.2
2,862,754 A * 12/1958 Forcia ..... A47G 21/045 294/7
3,003,236 A * 10/1961 Castelli ..... A61B 17/0467 30/234
3,281,179 A * 10/1966 Miller ..... B25B 7/02 294/106
D213,999 S * 4/1969 Lee ..... D14/129
4,527,331 A * 7/1985 Lasner ..... A61B 17/3201 30/135

(Continued)

*Primary Examiner* — Paul T Chin
(74) *Attorney, Agent, or Firm* — Reinhart Boerner Van Deuren P.C.

(57) ABSTRACT

An adjustable kitchen utensil includes a first component having a first handle portion, and a first serving portion attached to the first handle portion by a first connecting portion. An embodiment of the adjustable kitchen utensil includes a second component having a second handle portion, and a second serving portion attached to the second handle portion by a second connecting portion. This embodiment has an attachment mechanism for attaching the first and second components. The attachment mechanism permits adjustment of the size of a serving surface of the attached first and second serving portions. An alternate embodiment includes a removable handle subassembly.

7 Claims, 7 Drawing Sheets

(56) References Cited

U.S. PATENT DOCUMENTS

| | | | | | |
|---|---|---|---|---|---|
| 5,165,171 | A | * | 11/1992 | MacLean | B26B 3/00 294/7 |
| 5,176,418 | A | * | 1/1993 | Niu | A47J 43/288 294/7 |
| 5,192,106 | A | * | 3/1993 | Kaufman | G11B 23/00 294/16 |
| 5,206,998 | A | * | 5/1993 | Oriente | A47J 43/288 294/10 |
| 5,403,052 | A | * | 4/1995 | Lampron | A47J 43/288 294/7 |
| 5,671,553 | A | * | 9/1997 | Burkhart | E01C 23/082 172/372 |
| 5,791,053 | A | * | 8/1998 | Koong | A47G 21/10 294/99.2 |
| 5,934,721 | A | * | 8/1999 | Walde | A47J 37/0786 294/3 |
| D437,193 | S | * | 2/2001 | Kontou | D7/692 |
| D437,531 | S | * | 2/2001 | Kontou | D7/692 |

* cited by examiner

KITCHEN UTENSIL WITH ADJUSTABLE SERVING SURFACE

CROSS-REFERENCE TO RELATED PATENT APPLICATIONS

This patent application claims the benefit of U.S. Provisional Patent Application No. 61/886,749, filed Oct. 4, 2013, the entire teachings and disclosure of which are incorporated herein by reference thereto.

FIELD OF THE INVENTION

This invention generally relates to kitchen utensils, and more particularly to adjustable kitchen utensils.

BACKGROUND OF THE INVENTION

Embodiments of the invention represent an advancement over the state of the with respect to kitchen utensils. These and other advantages of the invention, as well as additional inventive features, will be apparent from the description of the invention provided herein.

BRIEF SUMMARY OF THE INVENTION

In one aspect, the invention provides an adjustable kitchen utensil that includes a first component having a first handle portion, and a first serving portion attached to the first handle portion by a first connecting portion. The adjustable kitchen utensil also includes a second component having a second handle portion, and a second serving portion attached to the second handle portion by a second connecting portion. There is an attachment mechanism for attaching the first and second components. The attachment mechanism permits adjustment of the size of a serving surface of the attached first and second serving portions.

In a particular embodiment, the first and second serving portions are triangular, while in an alternate embodiment, the first and second serving portions are rectangular.

In another aspect, the invention provides an adjustable kitchen utensil that includes an adjustable kitchen utensil having a spatula blade assembly with at least two blade members configured to move in relation to each other to vary the size of the spatula blade assembly. A removably attached handle assembly is attached to the spatula blade assembly. Manipulating the handle assembly causes the spatula blade assembly to vary in size.

In a particular embodiment, the handle assembly includes two arm members connected to each other at a first end, and each connected to the spatula blade assembly at a respective second end. A handle spring is configured to apply spring tension to the two arm members to urge the respective second ends away from each other.

In a further embodiment, the handle assembly is a single resilient member configured to maintain an original shape. In some embodiments, a first blade member includes one or more slots, and wherein a second blade member includes one or more rivets, the rivets being inserted through the slots and into the first blade member, such that the one or more rivets hold the first and second blade members together, wherein the rivets can slide along a length of the slots to adjust the size of the spatula blade assembly. In certain embodiments, the first and second blade members each have a front spatula portion and a rear spatula portion, the front spatula portion being perpendicular to the rear spatula portion. The removably attached handle assembly may be attached to the rear spatula portion.

Other aspects, objectives and advantages of the invention will become more apparent from the following detailed description when taken in conjunction with the accompanying drawings.

BRIEF DESCRIPTION OF THE DRAWINGS

The accompanying drawings incorporated in and forming a part of the specification illustrate several aspects of the present invention and, together with the description, serve to explain the principles of the invention. In the drawings.

While the invention will be described in connection with certain preferred embodiments, there is no intent to limit it to those embodiments. On the contrary, the intent is to cover all alternatives, modifications and equivalents as included within the spirit and scope of the invention as defined by the appended claims.

DETAILED DESCRIPTION OF THE INVENTION

Figure 1:
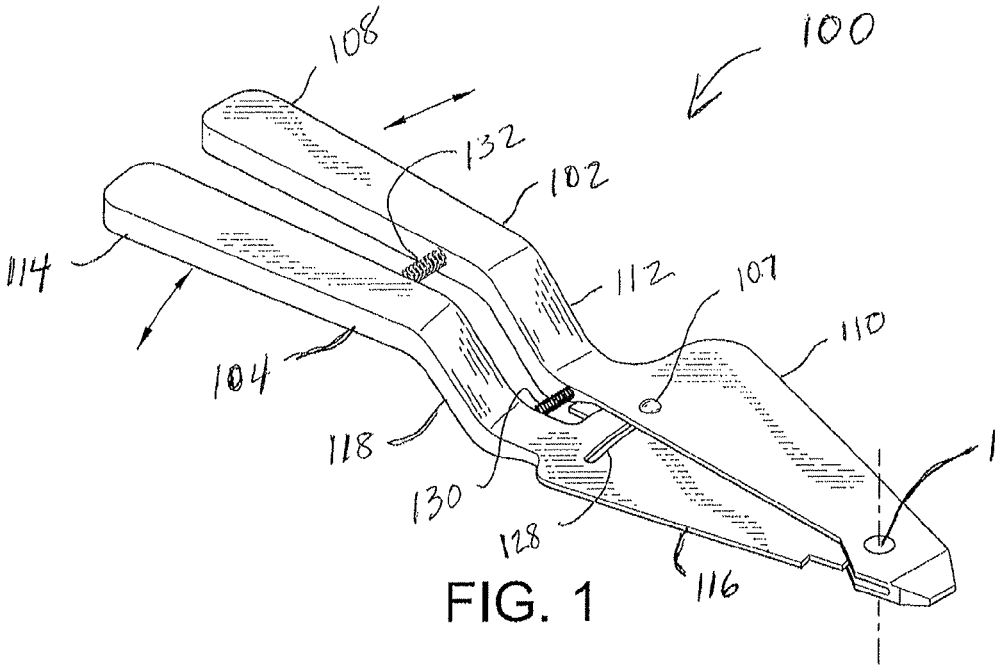
FIG. 1 is a perspective view of an adjustable kitchen utensil, constructed in accordance with an embodiment of the invention.
Figure 2:
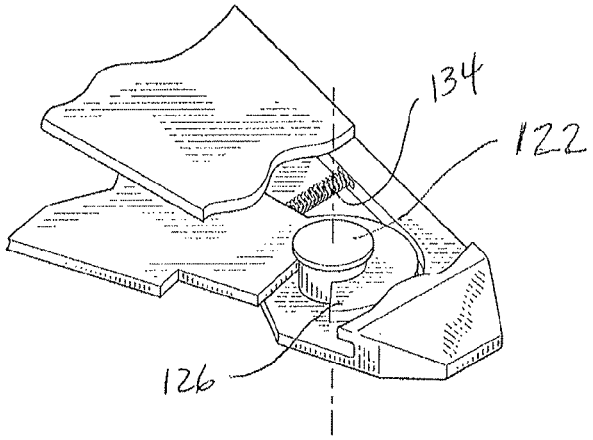
FIG. 2 is a close-up view of a portion of the adjustable kitchen utensil of FIG. 1.
Figure 3:
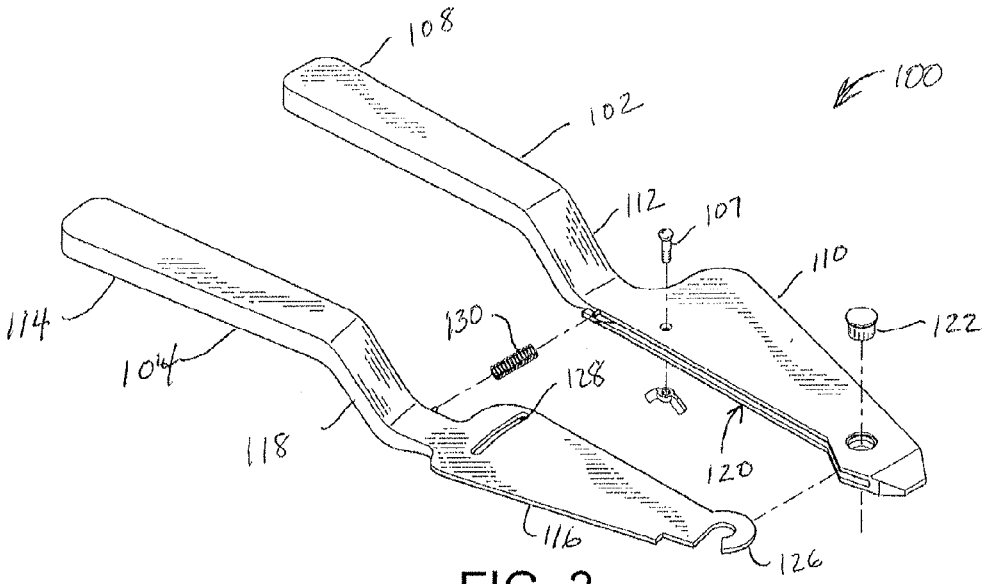
FIG. 3 is an exploded view of the adjustable kitchen utensil of FIG. 3, constructed in accordance with another embodiment of the invention.

FIG. 1 illustrates a perspective of an adjustable kitchen utensil 100, constructed in accordance with an embodiment of the invention. FIG. 2 illustrates a close-up view of a distal end of the adjustable kitchen utensil 100, while FIG. 3 shows an exploded view of the adjustable kitchen utensil 100 of FIG. 1. In this embodiment, the adjustable kitchen utensil 100, which is configured to serve food in portions of varying size, has a first component 102 and a second component 104 secured together by a stud 106 and fastener 107. The fastener 107 may include a bolt with a wingnut or some other suitable fastening means. While FIG. 3 shows the fastener 107 with the wingnut on a bottom surface of the adjustable kitchen utensil 100, it is understood that the wingnut or other fastening means may be on a top surface of the adjustable kitchen utensil 100. Alternatively, the stud 106 may be threaded to secure, for example, a wingbolt, which can be inserted from either above or below, without any wingnut or other fastener means. When assembled, the first and second components 102, 104 resemble a pie server, though it is not intended that the adjustable kitchen utensil 100 would be restricted to such uses.

In the embodiment of FIGS. 1 and 2, the first component 102 has a first handle portion 108 and a first serving portion 110 and a first connecting portion 112. The second component 104 has a second handle portion 114 and a second serving portion 116 and a second connecting portion 118. While the first and second connecting portions 112, 118 may be such that the respective serving portions and handle portions are substantially planar, in many embodiments, the connecting portions 112, 118 will be angled so that the respective serving portions and handle portions are located in substantially parallel planes. The angle may be set to facilitate use of the adjustable kitchen utensil 100 with common types of serving dishes, such as pie pans or baking dishes. As can be seen from FIGS. 1 and 2, the first serving portion 110 is generally triangular with generally smooth, flat top and bottom surfaces, and includes a hollow portion 120. Within this hollow portion 120, there is a cylindrical post 122 that connects the top and bottom surfaces. The cylindrical post 122 is located toward a distal end of the first serving portion 110 farthest from the first handle portion 108, such that, within the hollow portion 120, there is a gap 124 between the cylindrical post 122 and the tip of the first serving portion 110.

The second serving portion 116 is also generally triangular with generally smooth, flat top and bottom surfaces, but is shorter and thinner than the first serving portion 110. In this manner, the second serving portion 116 is capable of at least partially fitting within the hollow portion 120 of the first serving portion 110. At the distal end of the second serving portion 116, there is a hooked element 126 configured to fit around the cylindrical post 122. Proximate the second handle portion 114, the second serving portion 116 has a slot 128 to accommodate the stud 106. In certain embodiment, the stud 106 is stationary, being fixed in the first serving portion 110 proximate the first handle portion 108. However, in alternate embodiments, the stud 106 is removable. In such a case, the slot 128 does not have to be open-ended, and may be contained in an interior portion of the second serving portion 116.

In particular embodiments, the stud 106 is threaded, with a removable wingbolt, such that the wingbolt can be tightened to fix the position of the second component 104 in relation to the first component 102. In alternate embodiment, the wingbolt may be replaced by other suitable types of threaded fasteners. In a further embodiment, the stud 106 may be fixed in place in the first serving 110 portion of the first component 102. In this way, the stud 106 serves as a locking nut to maintain the desired width of the adjustable kitchen utensil 100. In particular embodiments, a spring element 130 connects the first handle portion 108 to the second handle portion 114. Optionally, a second spring element 132 may be connected between the first and second handle portions 108, 114. In an alternate embodiment, a resilient element 134, such as a spring, may be located inside the hollow portion 120, where this resilient element is compressed when the second serving portion 116 is fully nested within the hollow portion 120 of the first serving portion 110. Embodiments of the adjustable kitchen utensil 100 may have either spring 130, the resilient element 134, or both.

When assembled, the hooked element 126 pivots about the cylindrical post 122 during adjustment of the adjustable kitchen utensil 100. The tip of the hooked element 126 is configured to move within the gap 124. The slot 128 may be open-ended, that is, extend from an interior part of the second serving portion 116 to a perimeter of the second serving portion 116. As such, during assembly, the second serving portion 116 can be inserted into the hollow portion 120 of the first serving portion 110 such that the slot 128 engages the stud 106. In this manner, the second component 104 can be moved back and forth to adjust the width of the combined first and second serving portions 110, 116, while fixing the position of the first and second components 102, 104 with respect to each other in the lengthwise direction (e.g., from the proximal tip of the handle portion 108, 114 to the distal tip of the serving portion 110, 116). As mentioned above, a threaded fastener on the stud 106 can be tightened to set the desired width of the adjustable kitchen utensil 100.

Figure 4:
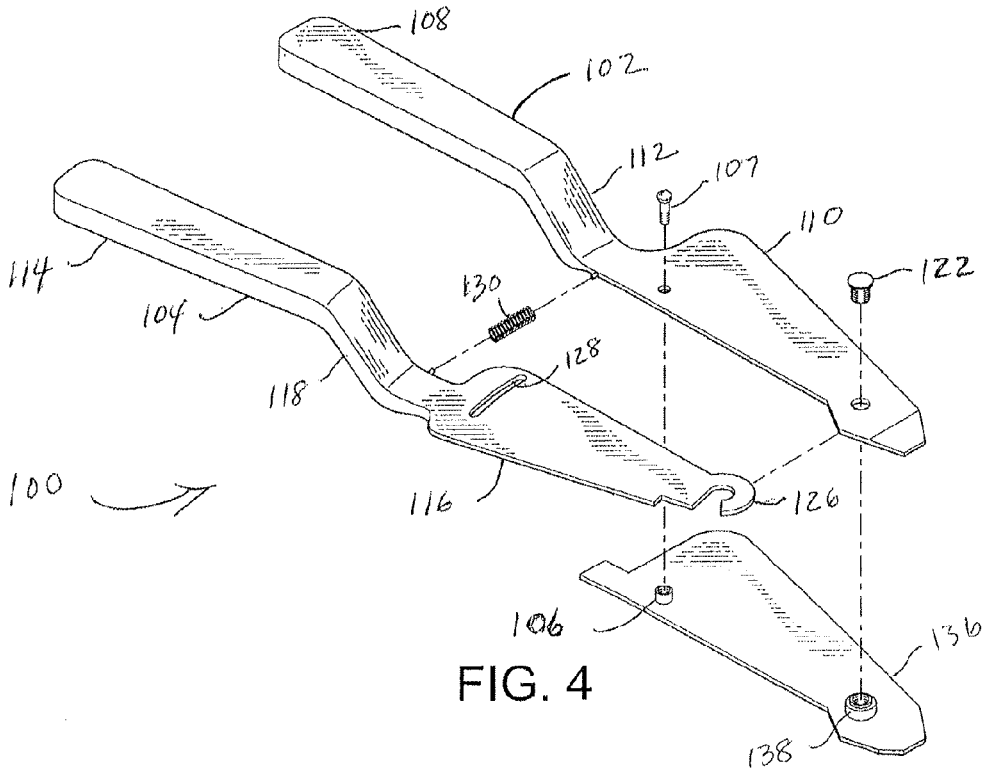
FIG. 4 is an exploded view of the adjustable kitchen utensil of FIG. 3 with a separate bottom plate.

While FIG. 3 shows that the first component 102 may be constructed as a single component, FIG. 4 illustrates an exploded view of the adjustable kitchen utensil 100 where the first component 102 is made from two assembled components. A bottom plate 136, which includes the stud 106 and a cylindrical post stud 138 to receive the cylindrical post 122, attaches to the first serving portion 110. When the bottom plate 136 is attached to the first serving portion 110, the space therebetween is the aforementioned hollow portion 120.

Figure 5:
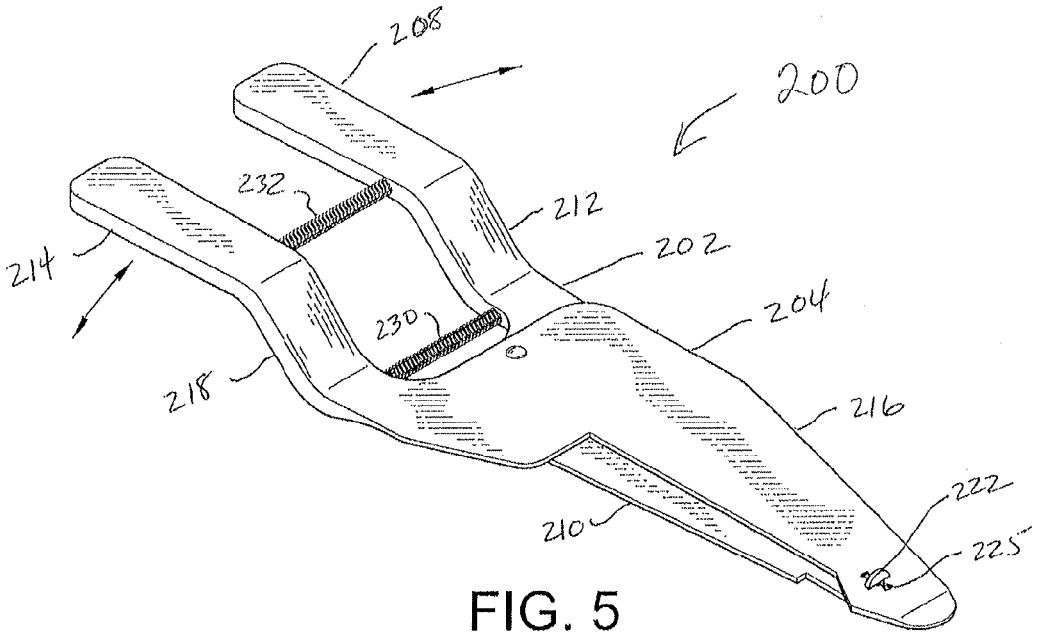
FIG. 5 is a perspective view of an adjustable kitchen utensil, constructed in accordance with yet another embodiment of the invention.
Figure 6:
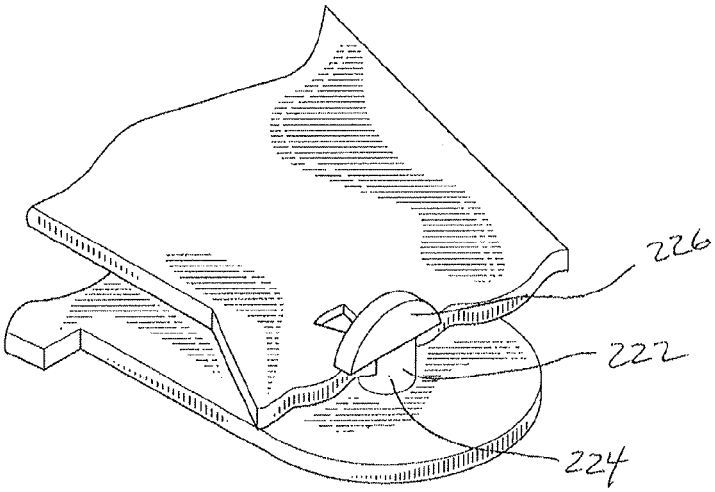
FIG. 6 is a close-up view of a portion of the adjustable kitchen utensil of FIG. 5.
Figure 7:
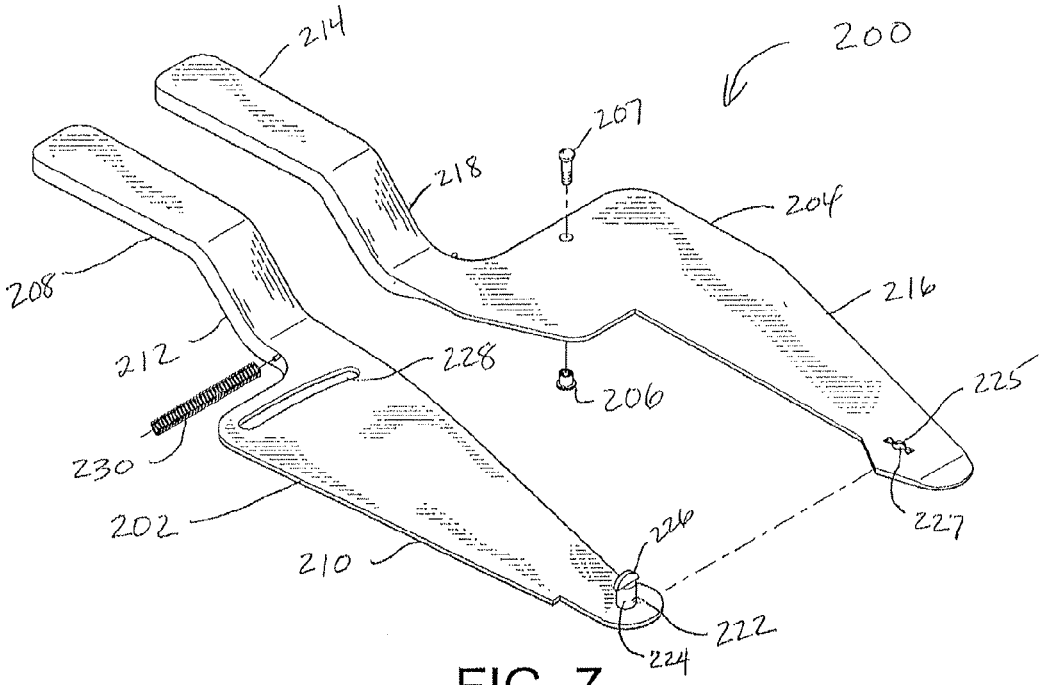
FIG. 7 is a exploded view of the adjustable kitchen utensil of FIG. 5.

FIG. 5 illustrates a perspective of an adjustable kitchen utensil 200, constructed in accordance with a particular embodiment of the invention. FIG. 6 illustrates a close-up view of a distal end of the adjustable kitchen utensil 200, while FIG. 7 shows an exploded view of the adjustable kitchen utensil 200 of FIG. 5. In this embodiment, the adjustable kitchen utensil 200 has a first component 202 and a second component 204 secured together by a stud 206 and fastener 207. In a particular embodiment, the stud 206 is threaded and configured to receive the fastener 207, which may be a wingbolt or some other type of threaded bolt. When assembled, the first and second components 202, 204 may have a shape similar to that of the first and second components 102, 104 shown in FIG. 1.

In the embodiment of FIGS. 5 and 7, the first component 202 has a first handle portion 208 and a first serving portion 210 and a first connecting portion 212. The second component 204 has a second handle portion 214 and a second serving portion 216 and a second connecting portion 218. While the first and second connecting portions 212, 218 may be such that the respective serving portions and handle portions are substantially planar, in many embodiments, the connecting portions 212, 218 will be angled so that the respective serving portions and handle portions are located in substantially parallel planes. The angle may be set to facilitate use of the adjustable kitchen utensil 200 with common types of serving dishes, such as pie pans or baking dishes. As can be seen from FIGS. 3 and 4, the first serving portion 210 is generally triangular, and, in particular embodiments, has generally smooth, flat top and bottom surfaces. Proximate the tip (i.e., distal end) of the first serving portion 210, there is a stud 222 that connects the top and bottom surfaces. In alternate embodiments, the stud could have a variety of shapes other than rectangular. In the embodiment of FIGS. 3 and 4, the stud 222 has a cylindrical base 224 and an elongated top portion 226 that extends well beyond the perimeter of the cylindrical base 224. Further, the stud 222 projects perpendicularly from the flat top surface of the first serving portion 210.

The second serving portion 216 is also generally triangular with generally smooth, flat top and bottom surfaces, but is shorter than the first serving portion 210. The second serving portion 216 has an opening 225 at the distal end (i.e., further from the handle portion 208). The opening 225 is shaped like to fit over the stud 222 in this case, but could have a wide variety of shapes to match the variety of shapes that could be used to form the stud. In the embodiment of FIGS. 5, 6 and 7, the opening 225 also has a circular center portion 227 to accommodate the round cylindrical base of the stud 222. Thus, the second component 204 can be assembled to the first component 202 by sliding the opening 225 over the stud 222 and rotating the second component 204 to the desired position. The second component 204 rotates about the cylindrical base of the stud 222. The extending rectangular top portion of the stud 222 holds the two pieces together after the second component 204 is rotated.

As in the embodiment of FIGS. 1 through 4 described above, the second serving portion 216 has a slot 228 to accommodate the stud 206 and fastener 207, which may be fixed or removable, as described above. As in the embodiment described above, the stud 206 and fastener 207 serves as a locking nut to maintain the desired width of the adjustable kitchen utensil 200. In particular embodiments, a spring element 230 connects the first handle portion 208 to the second handle portion 214. Optionally, a second spring element 232 may be connected between the first and second handle portions 208, 214.

However, unlike the above-described embodiment, the first serving portion 210 does not have a hollow portion. The first and second serving portions 210, 216 are configured to slide, like the blades of a pair of scissors, one over the other during to allow adjustment of the adjustable kitchen utensil 200. In an alternate embodiment of the invention, adjacent surfaces (for example, the top surface of the first serving portion 210 and the bottom surface of the serving portion 216) of the first and second serving portions 210, 216 have a series of lands, or ridges, and grooves that meshing movements between the first and second serving portions 210, 216 to maintain uniform contact between the opposing sliding surfaces.

Figure 8:
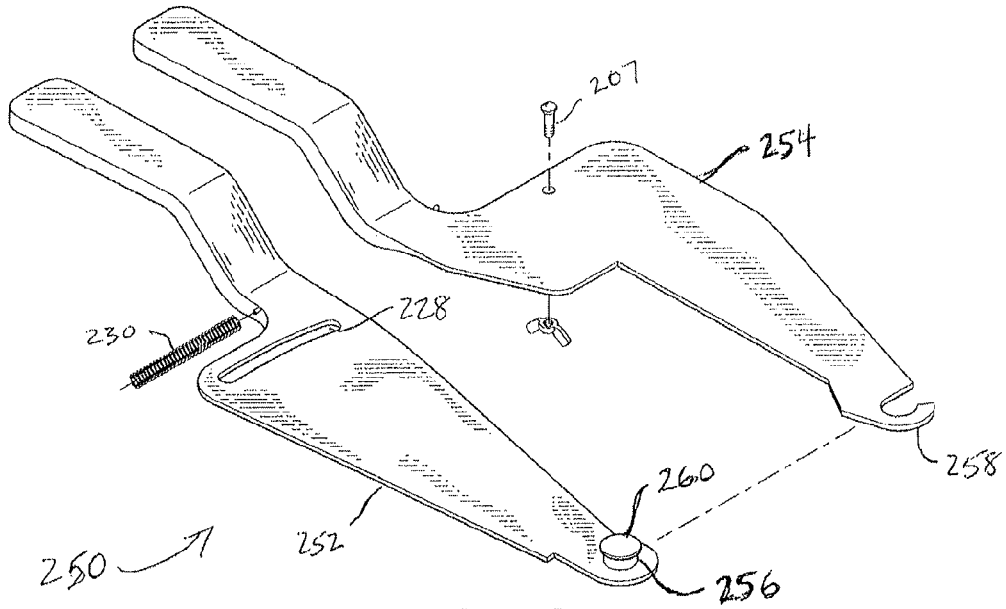
FIG. 8 is an alternate embodiment of the adjustable kitchen utensil of FIG. 5.

FIG. 8 shows an alternate embodiment of an adjustable kitchen utensil 250, which is similar to adjustable kitchen utensil 200, except for the connection at the distal end of a first component 252 and a second component 254. The first component 252 includes the slot 228 designed to accommodate the fastener 207 in second component 254. The fastener 207 may be a threaded bolt and wingnut, or any of a number of suitable fasteners which can be fastened within slot 228 to set the width of the serving portion of adjustable kitchen utensil 250. In certain embodiments, spring 230 is connected between the first and second components 252, 254.

At a distal end of the first component 252, there is a stud 256 designed to engage a hooked portion 258 of second component 254. The stud 256 has a crown portion 260 at the top which is wider than the base of the stud. The crown portion 260 keeps the hooked portion 258 from slipping off the top of the stud 256.

Figure 9:
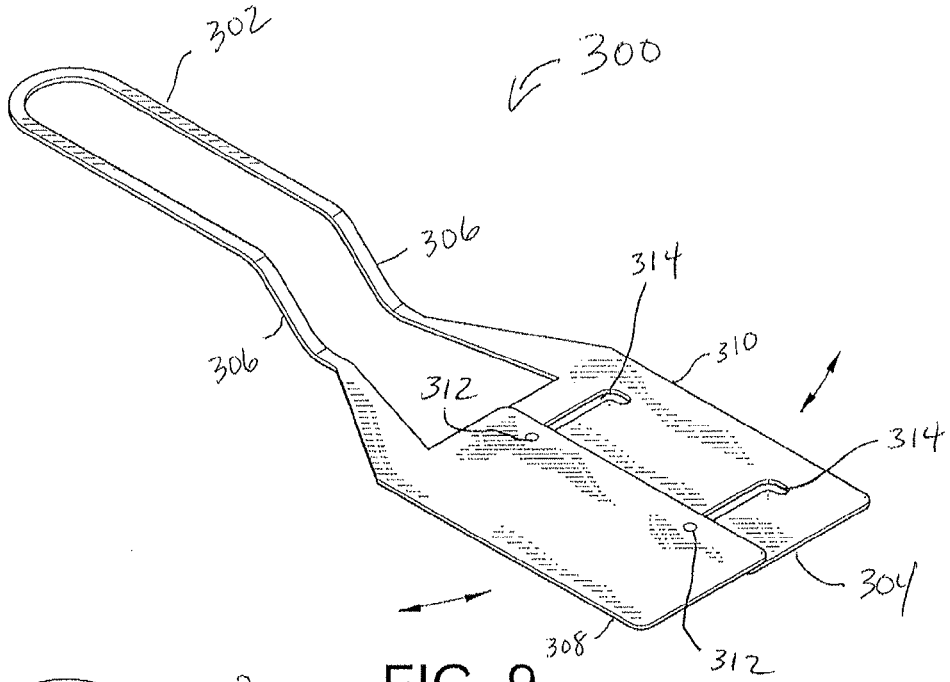
FIG. 9 is a perspective view of an adjustable kitchen utensil in a widened position, constructed in accordance with yet another embodiment of the invention.
Figure 10:
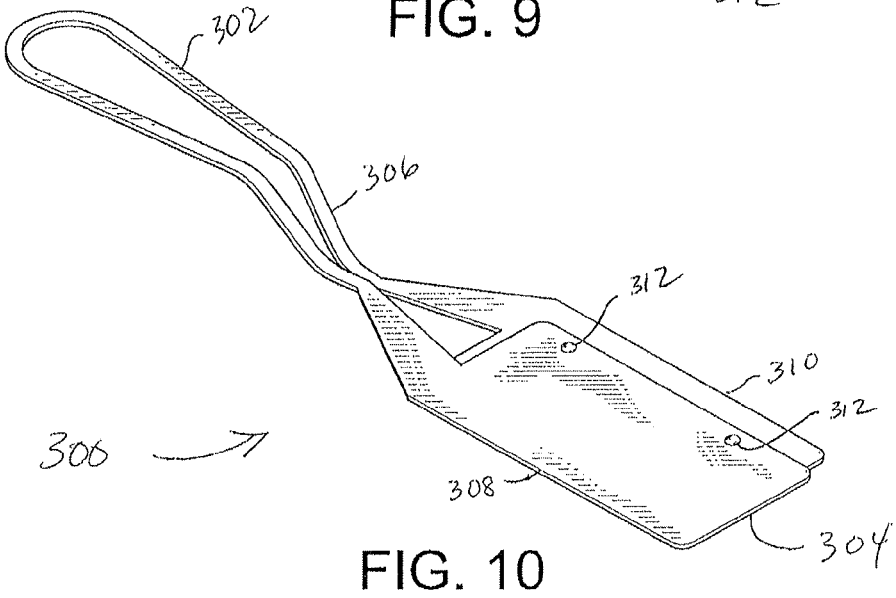
FIG. 10 is a perspective view of the adjustable kitchen utensil of FIG. 9 shown in a narrowed position.

FIGS. 9 and 10 illustrate perspective views of an adjustable kitchen utensil 300 in the widened and narrowed positions, respectively, constructed in accordance with an embodiment of the invention. In particular embodiments, the adjustable kitchen utensil 300 has a handle 302, a rectangular serving portion 304, and a connecting portion 306. It is understood that the serving portion could have a number of shapes other than rectangular. While the connecting portions 306 may be such that the rectangular serving portion 304 and the handle 302 are substantially planar, in many embodiments, the connecting portion 306 will be angled so that the serving portion 304 and handle portion 302 are located in substantially parallel planes.

In certain embodiments, the handle 302, rectangular serving portion 304, and connecting portion 306 are manufactured as a single piece. For example, in a particular embodiment, the handle 302 may consist of a single strip of material formed into a long "U" shape. The substantially parallel sides of the "U" has two ends that each transition into an angled piece of the connecting portions 306, which, in turn, broadens out to form the rectangular serving portion 304. In this manner, the rectangular serving portion 304 has two halves, for example, a first serving portion 308 and a second serving portion 310. The first and second serving portions 308, 310 may be equal or unequal in size.

These first and second serving portions 308, 310 are attached and detached by compressing the two halves to their smallest range of motion. In a particular embodiment, a stud is inserted into a hole or slot that is not on the plane of slots used in operating range of motion. This can be done because the handle itself acts as a spring, and can move inward or outward just as it can move left to right (laterally). As it is under a spring load, when the rivet is in line with the actuation slot, it snaps into place and is operational.

In the embodiment shown, the first serving portion 308 has two studs 312, though alternate embodiments may have greater or fewer than two studs. Studs 312 are designed to move from left to right (laterally), as viewed in FIGS. 9 and 10, within slots 314 in the second serving portion 310, to adjust the width of the serving portion of the adjustable kitchen utensil 300.

Figure 11:
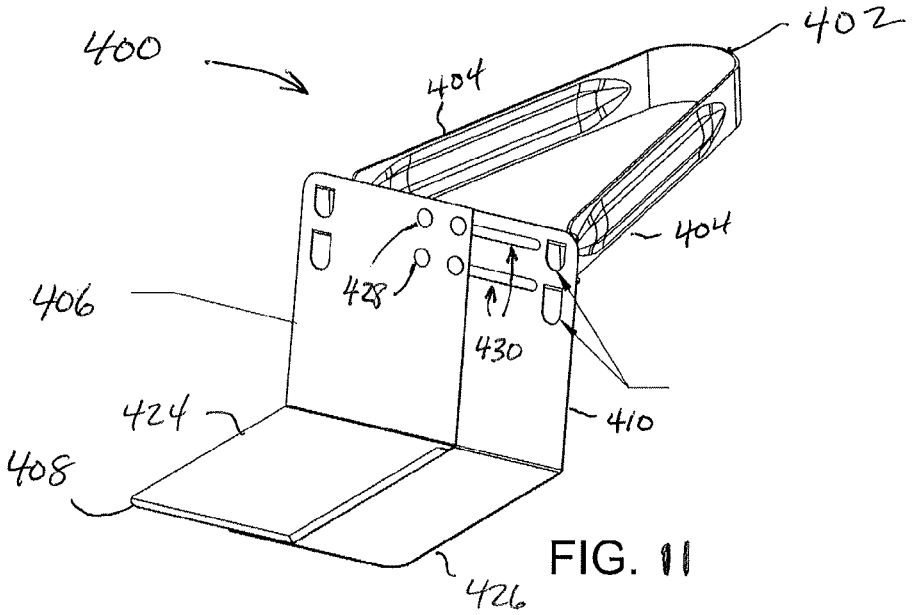
FIGS. 11 and 12 show assembled and exploded perspective views, respectively, of a square adjustable spatula assembly, constructed in accordance with an embodiment of the invention.
Figure 12:
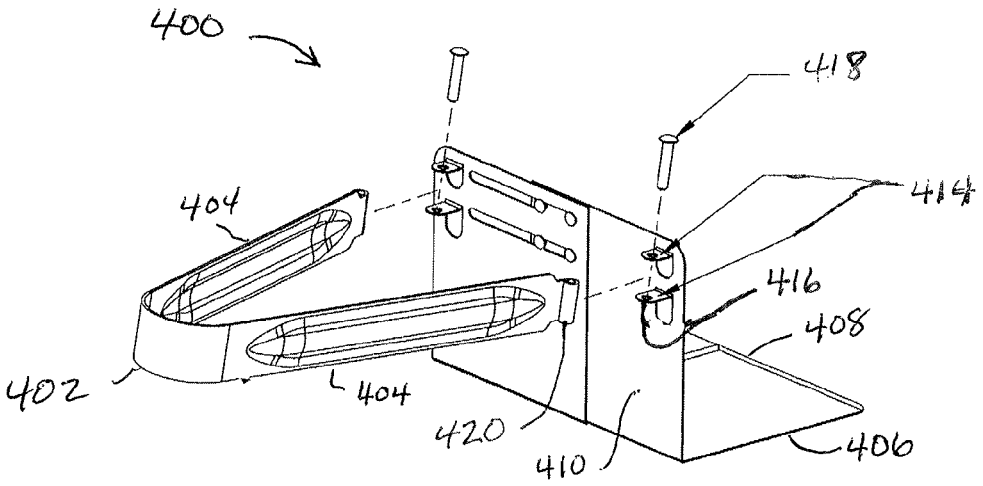
Figure 13:
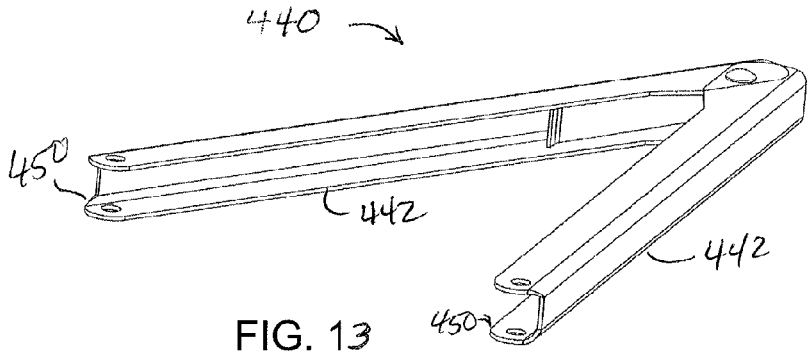
FIGS. 13 and 14 show assembled and exploded perspective views, respectively, of a two-piece handle sub-assembly, according to an embodiment of the invention.
Figure 14:
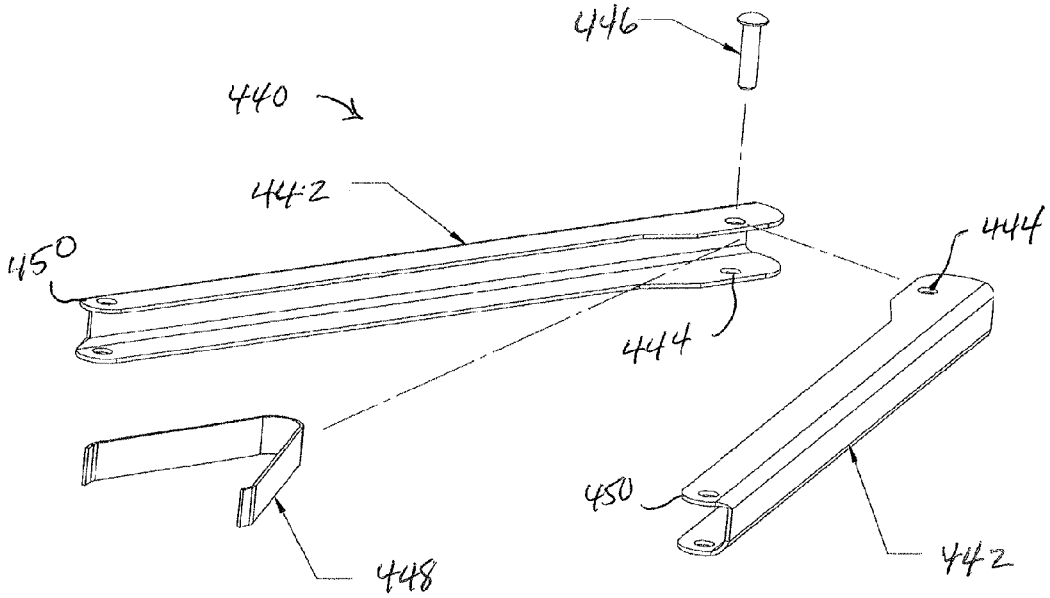

Alternate embodiments of the adjustable kitchen utensil are shown in FIGS. 11 and 12. FIGS. 11 and 12 show assembled and exploded perspective views, respectively, of a square adjustable spatula assembly 400, constructed in accordance with an embodiment of the invention. In the embodiment shown, a handle sub-assembly 402 has two arms 404, and may be constructed as a single piece (as shown in FIGS. 11 and 12), or assembled from separate pieces (as shown in FIGS. 13 and 14). The handle sub-assembly 402 may be made from metal (though other materials are also envisioned) bent or formed into U-shape, shown in FIGS. 11 and 12, and configured to resiliently maintain its shape. Thus, while the handle sub-assembly 402 may be manually closed or widened, like a spring it will tend to return to its natural position. The arms 404 of the handle sub-assembly 402 attach to a square spatula blade 406. The square spatula blade 406 has a front horizontal portion 408 and a rear vertical portion 410 to which the handle sub-assembly 402 is attached.

In a particular embodiment, two pairs of brackets 414 are attached on opposite sides of are rear surface of the rear vertical portion 410 of spatula blade 406. Each of the four brackets 414 has an opening 416 configured to receive a hinge pin 418. At the end of each arm 404 is a tip portion 420 with a formed opening, which is aligned with the bracket opening 416 such that the hinge pin 418 is inserted through the bracket openings 416 and tip portion opening to securely attach the handle sub-assembly 402 to the rear vertical portion 410 of spatula blade 406. The hinge pin 418 may be secured by a cotter pin or spring-loaded detent ball, for example. Squeezing the arms 404 of the handle sub-assembly 402 narrows the width of the square spatula blade 406.

In the embodiment shown, the square spatula blade 406 comprises a first half 424 and a second half 426. The first half 424 is designed to slide horizontally over the second half 426. When the adjustable spatula assembly 400 is at its minimum width, the first half 424 is slid over the second half 426 so that the front horizontal portion 408 and the rear vertical portion 410 of the first half 424 completely, or nearly completely, covers the front horizontal portion 408 and the rear vertical portion 410 of the second half 426. The square spatula blade 406 can be progressively widened such that when the adjustable spatula assembly 400 is at its maximum width, the first half 424 is essentially edge-to-edge, or side-by-side, with the second half 426.

To facilitate the adjustability of the square spatula blade 406, one or more pins, or rivet, 428 are inserted into the rear vertical portion 410 of the first half 424, and one or more corresponding slots 430 are cut into the rear vertical portion 410 of the second half 426. The one or more rivets 428 is inserted through the one or more corresponding slots 430 to hold the first and second halves 424, 426 together, while allowing the halve to adjust horizontally with respect to each other. The rivets 428 may be configured to lock the first and second halves 424, 426 into a set width. The rivets 428 could be threaded or otherwise configured so that they could be loosened whenever a new adjustment of the spatula assembly is needed, and then tightened, or relocked, as needed. It is envisioned that this concept would work equally well with triangular adjustable spatula assembly, where the tip of the triangular halves are connected.

FIGS. 13 and 14 show assembled and exploded perspective views, respectively, of a two-piece handle sub-assembly 440, according to an embodiment of the invention. Each of the two arms 442 has an opening 444 configured to receive a hinge pin 446. When the openings 444 of each arm 442 are aligned, the hinge pin 446 is inserted through each of the openings 444 to pivotably attach the arms 442. A resilient spring, which may be made from formed or bent metal, can be inserted between the arms 442 at the point of attachment to bias the arms in a particular position. The arms 442 can be squeezed manually to bring them together, but, when released, the resilient spring 448 will return thee arms 442 to their open position.

The two-piece handle sub-assembly 440 may be used with the square adjustable spatula assembly 400 of FIGS. 11 and 12, or with a similarly configured triangular spatula assembly. It should also be noted, that the two-piece handle sub-assembly 440 could be used with the adjustable kitchen utensil 100 of FIGS. 1-4. In such an embodiment, the triangular spatulas shown in FIGS. 1-4 would not have the integral handles shown, but each of the two-part triangular spatula portions would be attached to an end 450 of respective arms 442.

It should be noted that some or all of the adjustable kitchen utensils 100, 200, 300, and adjustable spatula assembly 400, may be fabricated from metal, plastic, wood, or other suitable material, or from some combination of these materials. Resilient components of these assemblies may be made from metal or other suitably resilient materials.

All references, including publications, patent applications, and patents cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) is to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. An adjustable kitchen utensil comprising:

a first handle portion, and a first serving portion attached to the first handle portion by a first connecting portion;

a second handle portion, and a second serving portion attached to the second handle portion by a second connecting portion;

an attachment mechanism for attaching the first and second serving portions, wherein the attachment mechanism permits adjustment of the size of a serving surface of the attached first and second serving portions;

a spatula blade assembly that includes the first and second serving portions, which are configured to move in relation to each other to vary the size of the spatula blade assembly; and a handle assembly that includes the first and second handle portions, each attached to the spatula blade assembly, wherein manipulating the handle assembly causes the spatula blade assembly to vary in size;

wherein the attachment mechanism comprises one or more slots in the first serving portion, and one or more rivets or pins in the second serving portion, the rivets or pins being inserted through the one or more slots of the first blade member, such that the one or more rivets or pins hold the first and second serving portions together, wherein the rivets or pins slide along a length of the one or more slots to adjust the size of the spatula blade assembly.

2. The adjustable kitchen utensil of claim 1, wherein the first and second serving portions are triangular.

3. The adjustable kitchen utensil of claim 1, wherein the first and second serving portions are rectangular.

4. The adjustable kitchen utensil of claim 1, wherein the handle assembly comprises:

the first and second handle portions connected to each other at a first end, and each connected to the spatula blade assembly at a respective second end; and wherein the handle assembly is configured to apply spring tension to the first and second handle portions to urge the respective second ends away from each other.

5. The adjustable kitchen utensil of claim 1, wherein the handle assembly is a single resilient member configured to maintain an original shape.

6. The adjustable kitchen utensil of claim 1, wherein the first and second blade members each have a front spatula portion and a rear spatula portion, the front spatula portion being perpendicular to the rear spatula portion.

7. The adjustable kitchen utensil of claim 6, wherein the removably attached handle assembly is attached to the rear spatula portion.

* * * * *